US008141542B2

(12) United States Patent
Joly

(10) Patent No.: US 8,141,542 B2
(45) Date of Patent: Mar. 27, 2012

(54) METHOD FOR THE COLD START OF AN INTERNAL COMBUSTION ENGINE

(75) Inventor: Philippe Joly, Gambais (FR)

(73) Assignee: Peugeot Citroen Automobiles SA, Velizy Villacoublay (FR)

( * ) Notice: Subject to any disclaimer, the term of this patent is extended or adjusted under 35 U.S.C. 154(b) by 218 days.

(21) Appl. No.: 12/668,361

(22) PCT Filed: Jun. 26, 2008

(86) PCT No.: PCT/FR2008/051169

§ 371 (c)(1),
(2), (4) Date: Jan. 8, 2010

(87) PCT Pub. No.: WO2009/007607

PCT Pub. Date: Jan. 15, 2009

(65) Prior Publication Data

US 2010/0192920 A1 Aug. 5, 2010

(30) Foreign Application Priority Data

Jul. 9, 2007 (FR) ..... 07 56357

(51) Int. Cl.
*F02M 51/00* (2006.01)
*F02M 51/06* (2006.01)

(52) U.S. Cl. ..... 123/491; 123/179.3

(58) Field of Classification Search ..... 123/491, 123/179.3, 179.15, 179.16, 674; 701/113
See application file for complete search history.

(56) References Cited

U.S. PATENT DOCUMENTS

| | | | | |
|---|---|---|---|---|
| 4,432,325 | A * | 2/1984 | Auracher et al. | 123/406.47 |
| 4,562,819 | A * | 1/1986 | Kobayashi et al. | 123/491 |
| 5,477,832 | A | 12/1995 | Visser | |
| 6,691,676 | B2 * | 2/2004 | Konno | 123/339.24 |
| 6,848,421 | B1 | 2/2005 | Karau et al. | |

FOREIGN PATENT DOCUMENTS

| | | | |
|---|---|---|---|
| DE | 4329448 | A1 | 3/1995 |
| DE | 19702556 | A1 | 7/1997 |
| EP | 1223326 | A2 | 7/2002 |

OTHER PUBLICATIONS

International Search Report and Written Opinion from corresponding to International Application No. PCT/FR2008/051169.

* cited by examiner

*Primary Examiner* — Mahmoud Gimie
(74) *Attorney, Agent, or Firm* — Polster, Lieder, Woodruff & Lucchesi LC

(57) ABSTRACT

The invention relates to a method for starting an internal combustion engine associated with a starter for driving the engine when starting the latter and to means for adapting the amount of injected fuel. According to the invention, the method comprises the following steps: during a first start operation, counting the number of revolutions (PMH) of the engine when it is driven by the starter; during a second starting operation following the first operation, adapting the amount (Q) of injected fuel based on the number of revolutions (PHM) counted during the first starting operation.

10 Claims, 2 Drawing Sheets

METHOD FOR THE COLD START OF AN INTERNAL COMBUSTION ENGINE

CROSS-REFERENCE TO RELATED APPLICATIONS

The present application is the U.S. national stage under 35 U.S.C. §371 of International Application No. PCT/FR2008/051169 which claims the priority of French application 0756357 filed on Jul. 9, 2007, the content of which (description, claims and drawings) is incorporated herein by reference.

BACKGROUND

The invention relates to a method for cold starting the internal combustion engine of an automobile. In general, the goal of the invention is to reduce at the origin the polluting emissions of gasoline engines.

The quality of fuel used for vehicles varies greatly, especially as a function of the geographical zone where the vehicles operate. A particularly variable physical property of fuel is its vaporizing capacity, in other words its varying volatility. This capacity is well known in Anglo-Saxon literature under the acronym RVP (Raid Vapor Pressure). This acronym will be used in the following description of the invention. Fuels that vaporize easily are called HRVP (High RVP) and fuels that do not vaporize easily are called LRVP (Low RVP).

In order to start correctly, a gasoline engine requires a mixture of air and gasoline close to the stoichiometric mixture. This assumes proper control of the quantity of fuel under gaseous form. According to the volatility of the fuel, the quantity of fuel under gaseous form that participates in the combustion during cold start and when the engine is cranked can vary enormously for the same quantity of injected fuel.

In order to ensure a sufficient quantity of fuel under gaseous form for proper combustion during start and cranking of the engine, calibrations are made with a fuel that is representative of a fuel with relatively low volatility (LRVP). Then, tests are performed to ensure that when a more volatile fuel is used, type HRVP, the injected quantities are not excessive and there is no risk that excess gasoline in vapor form will hinder the combustion, due to the mixture becoming non-inflammable.

Therefore, the adjustment is the same regardless of the fuel. Consequently, when a relatively more volatile fuel is used, the quantity of fuel in vapor form is excessive during start and cranking of the engine. This excess does not participate in the combustion and is found in the exhaust of the engine in the form of unburned hydrocarbons (HC). This has a direct impact on the polluting emissions of the engine because even if the vehicle is equipped with a catalyst, the catalyst is not cold primed and the unburned hydrocarbons escape to the atmosphere.

During start in extreme cold, when the ambient temperature is below −15° C., the excess fuel in vapor form also creates black smoke at the exhaust.

BRIEF SUMMARY

Attempts were made to resolve this problem by adjusting the quantity of fuel injected in an engine cylinder during the start phase as a function of the vaporizing capacity of the fuel. Since it is difficult to measure this capacity directly in a vehicle, the vaporizing capacity of the fuel was estimated as a function of the drop in engine speed when the quantity of injected fuel is reduced after the start of the engine. Since the reduction of the injected fuel quantity is calibrated, the drop in engine speed provides information representative of the vaporizing capacity of the fuel. The drop can be calibrated as a function of different fuel types having different vaporizing capacities. Nevertheless, other parameters have an influence on the drop in engine speed measured according to this method, specifically the internal friction of the engine.

Another method consists in measuring the time needed by the starter to start the engine. This time can be calibrated as a function of different fuel types. As previously mentioned, the internal friction of the engine influences the time needed by the starter to start the engine. The battery charge, the position of the clutch and the altitude where the vehicle is situated can also be mentioned as parameters influencing the time needed by the starter to start the engine.

These two methods improve the adjustment of the quantity of fuel injected in the engine during a start operation occurring after estimating the vaporizing capacity of the fuel. Nevertheless, the obtained result is not very reliable in the light of the numerous parameters influencing the performed measurements.

The invention is proposing to measure a parameter directly related to the vaporizing capacity of the used fuel, a parameter that is less sensitive than those previously measured.

To this end, the goal of the invention is a method for starting an internal combustion engine associated with a starter that cranks the engine during the start and means for adjusting the quantity of injected fuel, characterized in that during a first start operation, when the engine is cranked by the starter, the number of revolutions made by the engine is counted and during a second start operation, occurring after the first operation, the quantity of injected fuel is adjusted as a function of the number of revolutions counted during the first start operation.

Therefore, according to the invention, the count of the number of revolutions made by means of the starter is considered a representative measure of fuel volatility.

The invention improves the robustness of starter performance, in particular during cold start or even in extreme cold (exterior temperature below −15° C.). Indeed, the engine can only start when there is a sufficient quantity of vaporized fuel in a cylinder. Furthermore, prior to the first combustion, the injected quantities accumulate, at least partially, and increase until they reach the required quantity. Consequently, the number of engine revolutions before the first combustion is very representative of the volatility of the used fuel.

The count of the number of revolutions can be obtained by counting the number of times a piston passes through the upper dead point of a cylinder.

Furthermore, the rotational speed of the engine is measured in the vehicle. Therefore, the number of engine revolutions can be counted until the engine reaches a certain speed.

Other parameters can be taken into account for determining the quantity of fuel injected during the start. This quantity can be a function of the engine temperature measured during the second start operation and/or the speed of the engine during the second start operation.

The quantity of fuel injected during a start operation can have several discrete values. Each discrete value is associated with a range of revolutions made by the engine when it is cranked by the starter, and the retained value is a function of a comparison between the number of revolutions count and the different ranges.

During the second start operation, the count of the number of revolutions made by the engine when cranked by the starter during several previous first start operations can be taken into account. For instance, the average can be made of several starts or an aberrant count can be eliminated.

BRIEF DESCRIPTION OF THE DRAWINGS

The invention will be better understood and other advantages will come to light by reading the detailed description of an implementation mode, given as an example, and illustrated in the attached drawing in which.

For clarity purposes, the same elements have the same references in the different figures.

DETAILED DESCRIPTION

Figure 1:
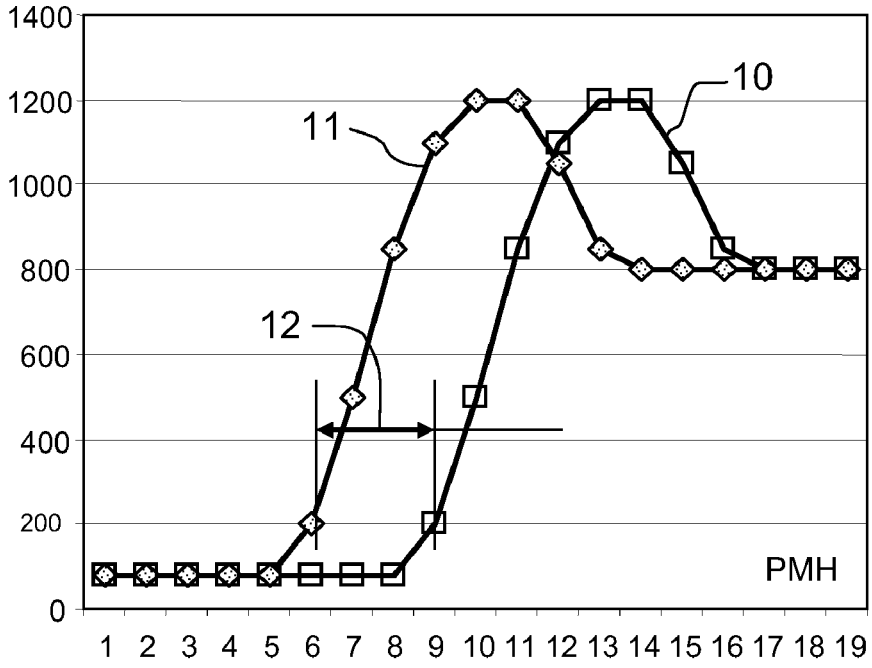
FIG. 1 shows the evolution of engine speed during a start operation as a function of the volatility (RVP) of the fuel used by the engine.

FIG. 1 represents a bundle of curves in a reference table with the number of revolutions made by the engine being the abscissa and the speed of the engine expressed in number of revolutions per minute being the ordinate. FIG. 1 shows two curves 10 and 11. They both represent the evolution of the engine speed during a start operation of the engine. For curve 10, the fuel used by the engine is LRVP type fuel (low vaporizing capacity) and for curve 11, the fuel used by the engine is HRVP type fuel (high vaporizing capacity). In the illustrated example, the engine is a reciprocating type engine. In one cylinder of the engine, the injection takes place close to the time that the piston traveling in the cylinder reaches the upper dead point of its stroke. In each curve 10 and 11, the engine speed is measured for each revolution of the engine, for instance, in the upper dead point, marked as PMH by a specific symbol which is diamond shaped for curve 10 and square for curve 11. A continuous line connects the symbols of each curve.

In curve 10, the engine speed is constant for the first eight revolutions of the engine. The speed is around 100 revolutions per minute. This speed corresponds with the time that the engine is cranked by the starter of the vehicle containing the engine. At the eighth revolution of the engine, combustion takes place in the subject cylinder, the speed of the engine increases and the starter no longer cranks the engine. Then, the speed of the engine increases until it reaches a maximum, around 1200 revolutions per minute, at the thirteenth or fourteenth revolution, then decreases to stabilize at 800 revolutions per minute starting from the seventeenth revolution. The stabilization corresponds with the idling speed of the engine.

Curve 11 represents the speed evolution of an engine using a fuel with higher RVP than the fuel used by the engine represented by curve 10. The speed of the engine is constant for the first five revolutions of the engine. During these five revolutions, the engine is cranked by the starter. At the fifth revolution of the engine, combustion takes place in the subject cylinder, the speed of the engine increases and the starter no longer cranks the engine. Then, curve 11 follows a progression parallel to that of curve 10, the speed of the engine increases until it reaches a maximum, around 1200 revolutions per minute, on the tenth and eleventh revolution, then decreases to stabilize at 800 revolutions per minute starting from the fourteenth revolution. This stabilization corresponds with the idling speed of the engine.

When observing these two curves, we see a gap 12 of three revolutions, between the fifth and eighth revolution during the time that the starter cranks the engine. This gap is directly related to the difference in RVP between the two fuels employed. To measure this gap, or more in general, the number of revolutions made by the engine between the engagement of the starter and the time that the engine runs without the aid of the starter, we can count the number of revolutions made by the engine beyond a specific speed value. This specific speed value can be selected above the maximum speed that the engine can turn when it is cranked by the starter.

Of course, other methods can be employed for counting the number of revolutions of the engine when cranked by the starter. For instance, the electrical current drawn by the starter can be measured. The starter can be replaced by an alternator-starter fulfilling the functions of starter and alternator. The variation of the voltage at the terminals of the alternator-starter allows to count the number of revolutions of the engine when cranked.

Figure 2:
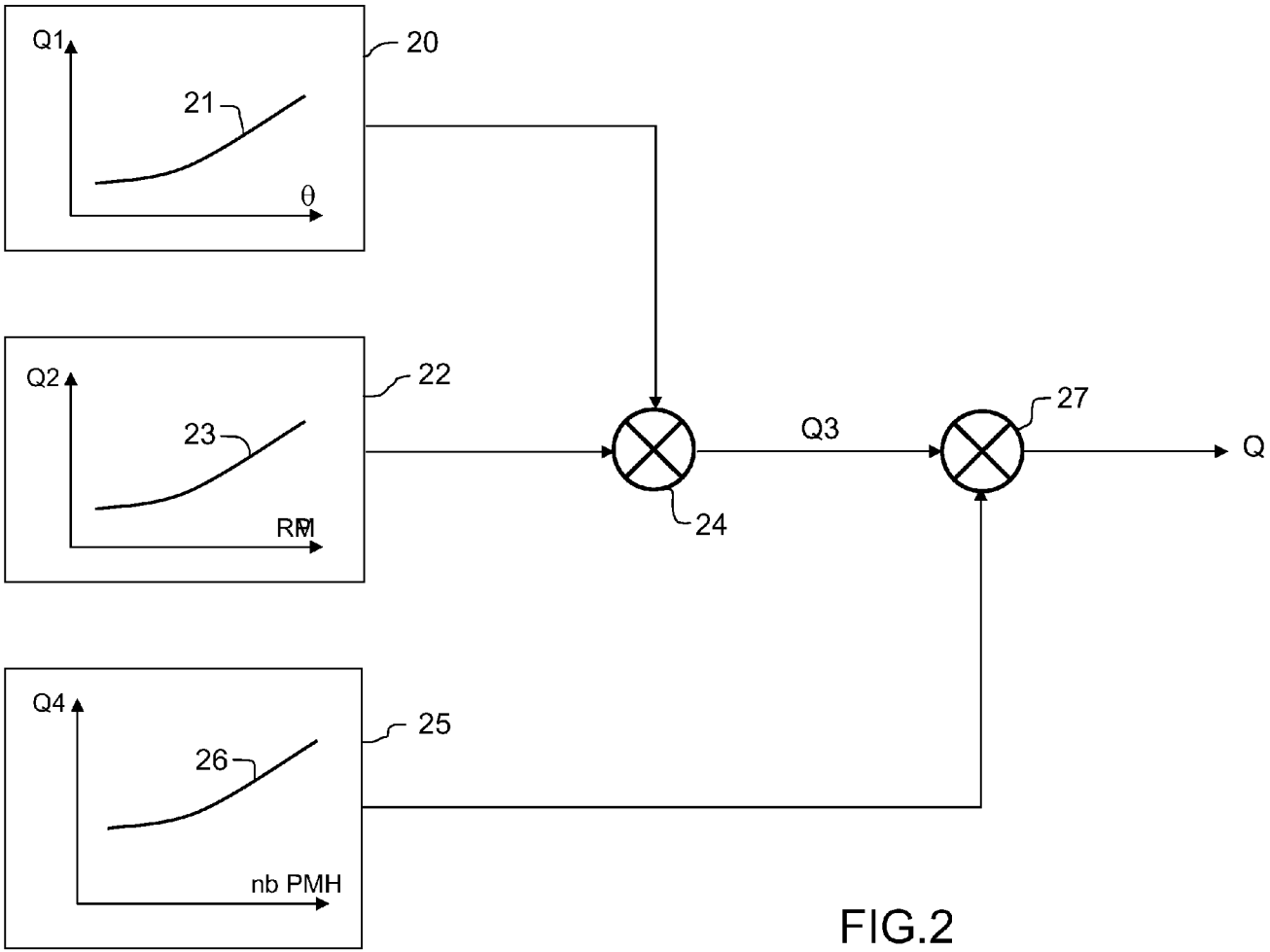
FIG. 2 illustrates the combination of several parameters intervening in the adjustment of the fuel quantity injected during start operations.

FIG. 2 illustrates the fact that the quantity of fuel to be injected in order to obtain a ratio close to the stoichiometric ratio during the start of the engine is a function of several parameters among which the temperature of the motor and its speed at the time of start.

In box 20, a curve 21 represents a quantity Q1 of fuel to be injected as a function of the temperature θ measured inside the engine. In box 22, a curve 23 represents a correction quantity Q2 to be added or subtracted from Q1 as a function of the engine speed RPM. These two parameters can be defined empirically and are independent of the quality of fuel used. These two parameters are combined to obtain a quantity Q3 of fuel to be injected as a function of the temperature θ and engine speed RPM. The combination is schematically represented by operator 24. In box 25, a curve 26 represents a correction quantity Q4 of fuel applied during a previous start, as a function of the number of revolutions PMH of the engine cranked by the starter during the last start. Curves 21, 23 and 26 shown in boxes 20, 22 and 25 are given only to illustrate the fact that a quantity of fuel can be defined as a function of one parameter. According to the invention, the quantity Q3 is weighted as a function of this quantity Q4 to obtain a quantity Q of fuel to be injected in order to obtain optimum starting. This weighting is schematically represented by operator 27.

The method according to the invention can be implemented in all start situations or only if the ambient temperature is below a certain threshold temperature, for instance lower than 10° C., or only in situations of extreme cold.

The present invention applies in particular to engines with spark ignition ("gasoline" engines), and more in particular to those engines capable of operating with relatively different fuels, specifically the so-called FLEXFUEL engines, which are supplied either with gasoline, or with mixtures more or less rich in ethanol or another product of vegetable origin.

The invention claimed is:

1. A method for starting an internal combustion engine associated with a starter that cranks the engine when the engine is being started and with means for adjusting a quantity of injected fuel, the method comprising:

during a first start, counting of the number of revolutions (PMH) made by the engine during cranking of the engine by the starter; and during a subsequent start, occurring after the first start adjusting the quantity (Q) of injected fuel as a function of the number of revolutions (PMH) counted during the first start.

2. The method of claim 1, wherein the step of counting of the number of revolutions (PMH) is accomplished by counting the number of times that a piston passes through an upper dead point in an engine cylinder.

3. The method of claim 1 wherein the step of counting the number of revolutions (PMH) comprises counting the number of revolutions (PMH) of the engine as long as the engine has not achieved a specific speed.

4. The method of claim 1 wherein the quantity (Q) of injected fuel is a function of the temperature θ of the engine measured during the second start.

5. The method of claim 1 wherein the quantity (Q) of injected fuel is a function of the speed of the engine (RPM) during the second start.

6. The method of claim 1 wherein the quantity (Q) of fuel injected during a start can assume several discrete values; each said discrete value is being associated with a range of revolutions (PMH) made by the engine when it is cranked by the starter; the method further comprising determining a retained value as a function of a comparison between the counted number of revolutions (PMH) and the range of revolutions for said several discrete values.

7. The method of claim 1 wherein during the second start, the method further comprises taking into account the count of number of revolutions (PMH) made by the engine when the engine is cranked by the starter in the course of several previous starts.

8. The method of claim 1 wherein said method is used only if the ambient temperature is below a certain temperature threshold.

9. The method of claim 1 wherein said method is applied to an engine with spark ignition.

10. The method of claim 1 wherein said method is applied to a FLEXFUEL type engine.

* * * * *

UNITED STATES PATENT AND TRADEMARK OFFICE

CERTIFICATE OF CORRECTION

PATENT NO. : 8,141,542 B2
APPLICATION NO. : 12/668361
DATED : March 27, 2012
INVENTOR(S) : Philippe Joly It is certified that error appears in the above-identified patent and that said Letters Patent is hereby corrected as shown below:

In column 5, Claim 6, line 13, the word "is" should be deleted.

Signed and Sealed this
Twenty-fifth Day of September, 2012

David J. Kappos

David J. Kappos
*Director of the United States Patent and Trademark Office*